United States Patent [19]

Fritz

[11] 4,327,528

[45] May 4, 1982

[54] INSULATED SIDING SYSTEM

[75] Inventor: Jack E. Fritz, Walled Lake, Mich.

[73] Assignee: Wolverine Aluminum Corporation, Lincoln Park, Mich.

[21] Appl. No.: 125,872

[22] Filed: Feb. 29, 1980

[51] Int. Cl.[3] ..... E04C 2/34; E04C 2/10

[52] U.S. Cl. ..... 52/309.1; 52/533; 52/539; 52/407

[58] Field of Search ..... 52/520–522, 52/529, 530, 539, 553, 531, 534, 302, 303, 404, 407, 409, 309.1, 478, 533

[56] References Cited

U.S. PATENT DOCUMENTS

| | | | |
|---|---|---|---|
| 2,007,374 | 9/1935 | Kuehne | 52/407 |
| 2,157,359 | 5/1939 | Tapman | 52/539 |
| 2,777,549 | 1/1957 | Roebuck | 52/529 |
| 3,204,379 | 9/1965 | Osborn | 52/303 |
| 3,214,876 | 11/1965 | Mattes | 52/522 |
| 3,228,164 | 1/1966 | Ettore | 52/303 |
| 3,552,078 | 1/1971 | Mattes | 52/520 |
| 4,033,802 | 7/1977 | Culpepper et al. | 52/531 |

FOREIGN PATENT DOCUMENTS

| | | | |
|---|---|---|---|
| 583955 | 9/1959 | Canada | 52/534 |

*Primary Examiner*—James L. Ridgill, Jr.
*Attorney, Agent, or Firm*—Harness, Dickey & Pierce

[57] ABSTRACT

An improved insulated vinyl siding system for houses and other buildings is disclosed. A sheet of foam insulation is disposed and held in place in the back of the siding panels in such a way to leave two air spaces, one between the insulation and the siding panel and the second between the insulation and the house surface. Openings are provided in the siding panels and act in cooperation with openings in the house to allow escape of trapped moistured air from the second air space.

19 Claims, 6 Drawing Figures

INSULATED SIDING SYSTEM

BACKGROUND-SUMMARY OF THE INVENTION

The invention herein relates to an insulated siding system which is particularly suitable for houses, but is also applicable to structures and buildings of all types. In the covering of the exterior of buildings, either in new construction or as a covering over existing materials, such as wood siding, it is conventional to use a siding system made up of individual panels of metal or plastic. The metal siding is usually aluminum or steel and the plastic siding is usually polyvinyl chloride (commonly referred to as "vinyl"). The siding panels are attached to the structure by nailing, typically through holes formed in a flange on each panel. Trim strips and other siding accessories are used to finish off the building surfaces on the edges, corners and around windows and doors.

Most siding systems made of metal or vinyl have little thermal insulation properties. Where this is desired, siding systems utilizing sheets or layers of insulation are utilized. These systems typically take several forms. In one system, a long, narrow sheet of foam insulation board is dropped in place behind each panel as it is being installed. In a second system, the insulation is glued directly to the back of the panels before the panels are installed in place. In another system, the insulation is foamed into place at the factory filling the hollow profile cross-section in the back of the panels. In still another system, the insulation is provided in large sheets (e.g. 4×8 feet) and nailed directly to the structure and the paneling is then installed over the insulation. Examples of some of these conventional systems are shown in U.S. patent to Sanders et al., U.S. Pat. No. 4,034,528 issued July 12, 1977, U.S. patent to Mattes, U.S. Pat. No. 3,552,078 issued Jan. 5, 1971, and U.S. patent to Sallie et al., U.S. Pat. No. 3,304,676 issued Feb. 21, 1967. Other types of insulated siding systems are shown in U.S. patent to Thomas, U.S. Pat. No. 2,126,676 issued Aug. 9, 1938, and U.S. patent to O'Brien, U.S. Pat. No. 3,054,223 issued Sept. 18, 1962.

Although known insulated siding systems may provide superior thermal insulation properties over non-insulated siding systems, they still may allow significant air filtration and thermal conductivity to take place which adversely affect the desired insulation effects. In the known systems, little or no air space is provided between the siding and the structure and, if provided, the air in the space is allowed to mix with and flow to the atmosphere (this is called "air filtration"). Frequent surface-to-surface contact is also made in the known systems between the panels and the structure allowing significant thermal conductivity to take place through the materials themselves between the outside atmosphere and the structure. Often the insulation fills the entire space behind the panels and/or makes full surface-to-surface contact with the structure.

It is a purpose of the present invention to provide an insulated siding system, preferably made of vinyl, which is an improvement over known systems. The invention considerably reduces thermal conductivity and air filtration and increases the "R" rating of the siding system (which is the recognized rating of thermal insulation of a product).

The inventive siding panels are shaped to hold an elongated sheet of foam insulation behind them. The insulation is positioned in the panel so that it is spaced from both the panel front and the building, thus providing two air spaces behind the panel. The air space adjacent the structure is designed to provide as little air filtration as possible and thus effectively provide a "dead air space". Notches or openings in each of the panels allow the "dead air spaces" behind all of the panels in an area to be in contact. These openings, together with corresponding passages formed in the soffits or overhangs of the buildings, allow any trapped moisturized air to flow upwardly out of the space and escape preventing moisture damage.

Other objects, features and advantages of the present invention will become apparent from a study of the following description when taken in connection with the accompanying drawings.

DESCRIPTION OF THE INVENTION

Figure 1:
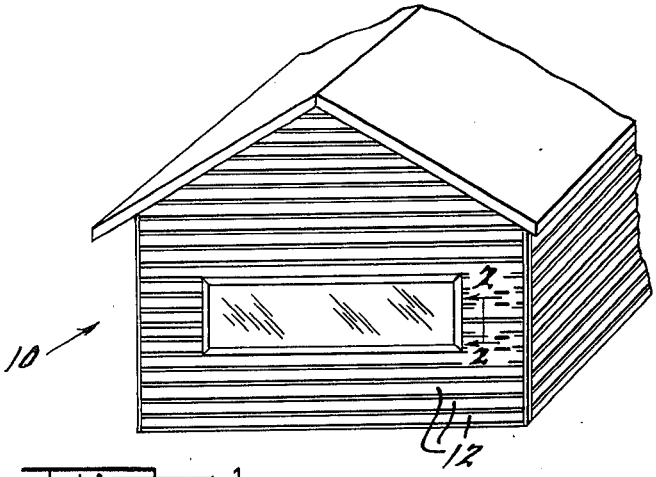
FIG. 1 shows a building with the inventive siding system installed thereon.
Figure 2:
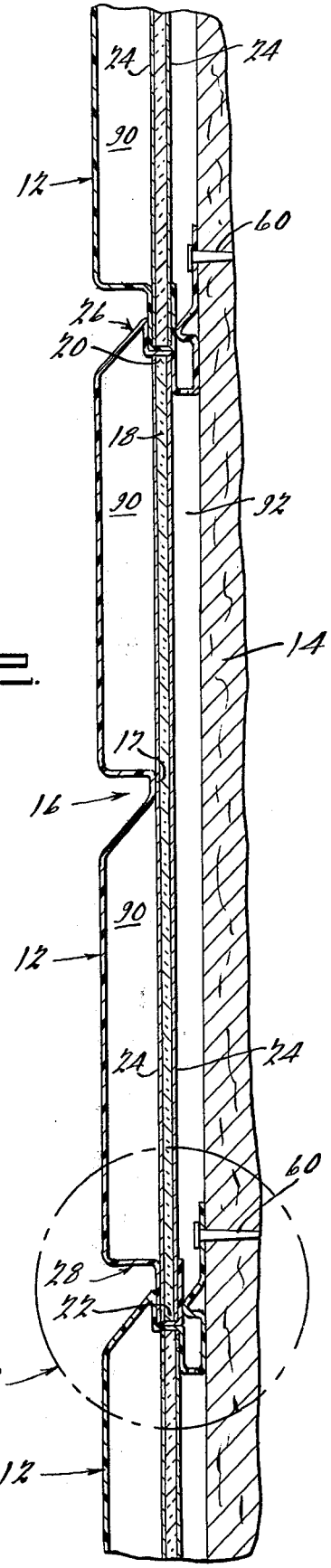
FIG. 2 is a cross-section of one surface of the building of FIG. 1 taken in the direction of the arrows 2—2.
Figure 3:
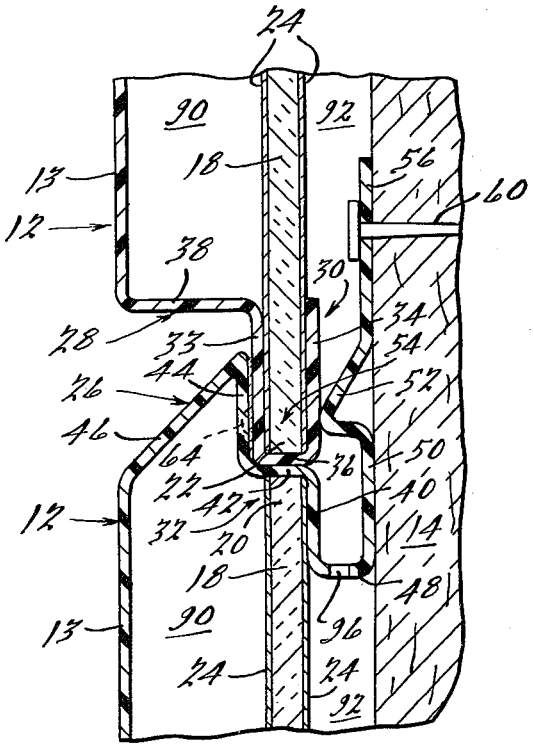
FIG. 3 is an enlarged view of the circular portion of FIG. 2 indicated by the numeral 3.

FIG. 1 depicts a house 10 or similar structure in which the present inventive siding system is installed on the exterior surface. Although the invention is applicable to buildings and structures of all types, it will be described hereinafter for convenience and ease of description relative to houses which are the preferred structure for application of the invention. Similarly, although the invention has beneficial application to siding systems made of all of the known types of materials, such as steel, aluminum and vinyl, it will be described herein only relative to the preferred material vinyl.

As shown in FIGS. 2–5, the house is covered by a plurality of elongated vinyl siding panels 12. Typically, the panels are installed on all of the exterior wall surfaces 14 of the house. In the drawings, the panels are shown to be installed horizontally on the house, which is the most common way siding systems are installed on houses today. It is to be understood, however, that the present invention has equal applicability to siding systems in which the panels are installed or positioned vertically (which also is a common type of siding system).

The panels 12 have a broad, front wall member or surface 13 which can be a single plane surface or divided by molded grooves 16 into two or more plane surfaces. Preferably, vinyl panels have a central support of some type in order to prevent the front wall from wrinkling and thus usually have at least one groove dividing the front surface into two or more areas.

A flat sheet of foam insulation material 18 is positioned on the inside of each panel 12 and held in place at both ends 20 and 22. The insulation preferably is one-half inch thick and made of urethane foam. Commercial products which can be used in this regard are Thermax by Celetax, Inc., Tampa, Florida, and Insulated Board Foam by United Foam, Inc., Breman, Indiana. The insulation 18 also can be other types of known or available materials which are used as insulation, such as polystyrene beadboard. The sheet 18 can be utilized without any backing or laminate attached thereto, but preferably has a thin aluminum foil sheet 24 mounted on both sides thereof. The aluminum foil aids in the manufacture of the foam sheet and also helps its insulative properties.

The upper edge 26 and lower edge 28 of the panels have channels 32 and 30, respectively, formed therein in which the ends of the foam sheet 18 are positioned. Preferably, these channels are made as part of the extruded profile section of the panel. As shown more specifically in FIGS. 2–4, the channels contain and hold in place the sheet of insulation behind the panel and also space the insulation both from the front surface of the panel and the house exterior wall on which the panel is fastened.

The channel 30 in the lower edge 28 of the panel is generally U-shaped with upwardly extending wall members 33 and 34 joined by bottom connecting wall member 36. The U-shaped channel 30 in turn is connected to the front surface 13 of the panel 12 by wall member 38 which, as shown, is substantially perpendicular to such front surface. The channel 30 does not come directly into contact with the exterior wall 14 of the house, but is positioned a distance therefrom by part of the upper edge 26 of an adjacent panel in which it is mated and nested (as described below).

The upper edge 26 of the panel is adapted to mate with a lower edge 28 of an adjacent panel, hold that edge 28 firmly in position and spaced from the surface of the base 14, and also hold one edge of the sheet of insulation 18. The channel 32 in the edge 26 is approximately L-shaped and is formed by wall members 40 and 42. Channel 32 holds the upper end of insulation 18 in place in cooperation with the groove 16 in the center of the panel. The wall members forming the groove 16 extend inwardly from the front surface 13 of the panel toward the house and form a support 17 against which the insulation rests. The support 17 contacts the insulation on the side opposite to that which rests against wall member 40.

Figures 4, 5:
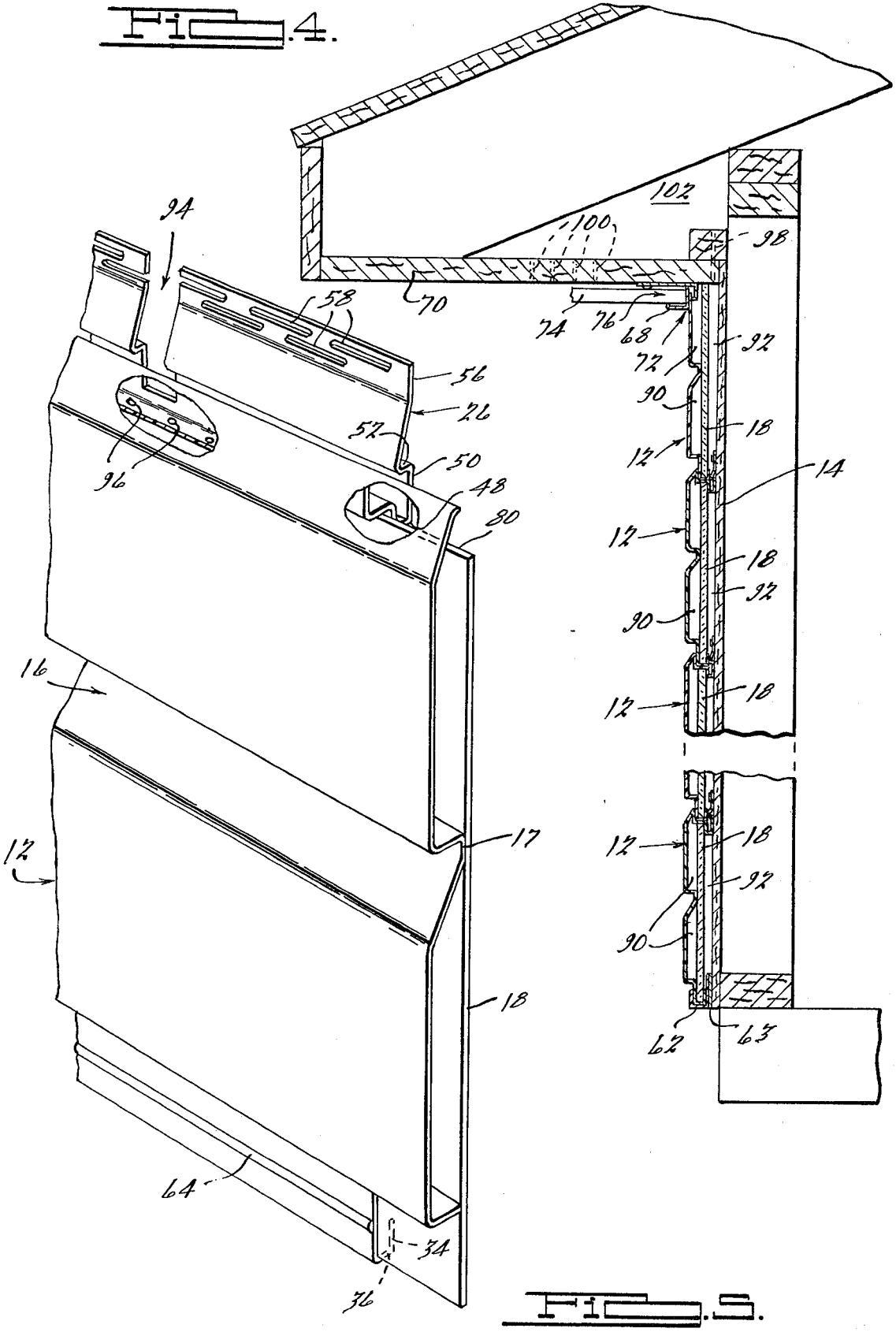
FIG. 4 is a cross-section of a wall of a typical building depicting how the present inventions is installed thereon.
FIG. 5 is a perspective view of a siding panel in accordance with the invention and illustrating certain features thereof.

The channel 32 is connected to the front wall 13 of the panel 12 by transverse wall member 44 and slanted wall member 46. At the back of the channel 32 (i.e. the side closest to the house), the panel 12 is adapted to rest on and be attached to the house. The channel wall 40 is connected by a short wall member 48 and in turn to an upwardly extending nailing flange 50. The flange 50 has an elongated rib member 52 thereon which acts in cooperation with the wall portions 44 and 42 to define a third channel or groove 54 in which the lower edge 28 of an adjacent panel mates and nests. The flange 50 also has a nailing portion 56 which extends upwardly past the other wall members 40, 42, 44, 46 and 48 and has a plurality of aperatures 58 formed therein (FIG. 5). Thus, when the panels 12 are placed in position along the outside surface of the house, each panel is firmly fastened thereto by nails 60 or other appropriate fastening means. In order to provide installers with complete flexibility in the choice of positions in which to fasten the panels to the house, the aperatures 58 are preferably in the shape of elongated slots and are arranged in two or more rows.

When the siding system is installed on a house, a starter trim strip is first fastened on the bottom of each side of the house. A starter strip is shown in FIG. 4 and designated by the numeral 62. The strip 62 preferably is a conventional "J-channel" (formed with its own nailing flange) as shown in FIG. 4. In order to space the insulation the requisite distance from the wall of the house at the bottom, a thin wood strip (lathe) 63 is secured in place behind the J-channel. It also is possible to form a modified J-channel with a wider channel and an elongated rib member formed on it which corresponds in function and purpose to rib member 52 of the panels 12. In the latter instance, a wood strip would be unnecessary.

After the starter strip 62 is secured in place, a first course of siding is installed horizontally along the width of a wall surface of the house. The lower edge 28 of each elongated panel is dropped into the U-channel in the starter strip and the panel is secured in place against the house by a plurality of nails driven through the slots in the nailing flange 50. Then, a second and successive courses of siding are similarly installed in place. For each course, the lower edges 28 of the panels 12 are mated and nested in the channels 54 of the immediately adjacent panels and the upper edges 26 nailed to the house. The channel 54 holds the edge of an adjacent panel firmly in place. The mating structure on the edges 26 and 28 of each panel which allows rows of paneling to be interconnected together can be viewed as a "tongue-and-groove" structure. To insure a close fit free from rattles, the panel edges preferably are formed so that outside surfaces of the "tongues" on the lower edges come into contact with the surfaces forming the "groove" on the upper edges.

Figure 6:
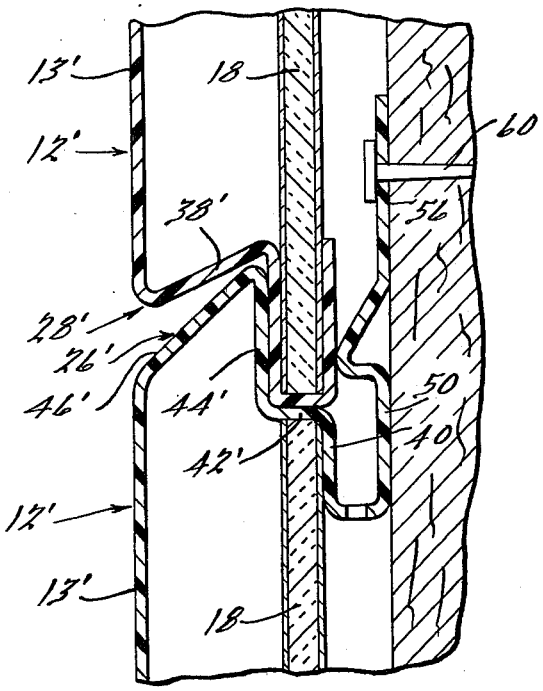
FIG. 6 shows an alternate form of the siding panels.

In order to provide a water-tight fit between adjacent panels, preferably the panel edges 26 and 28 are formed as shown in FIG. 6. (The revised features of FIG. 6 are numbered the same as the corresponding features in the other Figures, except that a ′ (prime) has been added to them.) In this embodiment, the wall portion 38′ of edge 28′ is angled downwardly toward the front surface 13′ of each panel 12′ forming a drip edge. In addition, the wall portion 44′ of edge 26′ is lengthened in order to allow the upper edge of wall portion 46′ to nest more closely to wall portion 38′. With this embodiment, even driving rains should not cause any water to pass between the joints of adjacent panels.

In the alternative, or in combination with the embodiment of FIG. 6, it is possible to seal the joint between the panels at channel 54 with a sealing material, such as silicone. For this purpose, an elongated bead 64 of silicone may be provided on the exterior surface of the wall member 33. Thus, when adjacent panels are mated together, the silicone bead is flattened and spread out sealingly joining the wall portions 33 and 44.

When the course of siding reaches the top of a wall surface, a trim or accessory strip is provided which either caps off the siding system on that side of the house or provides a connection between the vertical wall surface and the other surfaces of the side, such as the soffit, overhand, or fascia. A soffit-fascia arrangement is shown in FIG. 4. In this instance, a "double J-channel" 68 is provided which is nailed to the soffit 70 of the house and is adapted to hold the thin edges of the paneling in one channel 72 and the wider side edges of the soffit paneling 74 in a second channel 76. The double J-channel 68 is preferably made of vinyl and is of the profile shape shown. The channel 68 is further described in detail in co-pending patent application Ser. No. 937,878, filed on Aug. 29, 1978 and entitled "Improved Channel Member for Siding Construction", now U.S. Pat. No. 4,189,885 which issued on Feb. 25, 1980, which is owned by the same assignee as the present application.

It is also understood that any type of conventional trip strips and accessories can be used at the intersection of the walls and soffits of the house, such as one or two conventional J-channels.

The panels 12, since they preferably are vinyl, are profile extruded in the specific cross-sectional shapes desired. The panels, however, also can be molded, vacuum-formed, bent or roll-formed from sheet material, as is commonly known and understood in the trade depending on the type of material utilized, the specific exterior texture, pattern or finish desired, and the economics involved. The panels further can be fabricated in pre-specified lengths for the particular job application desired, or can be formed in standard lengths and cut to size at the building site.

The portion of the profile shape which is visible on the exterior of the house can be of any desired pattern, shape or configuration. Typically, however, house siding is manufactured to simulate wood siding (which it covers or replaces) and thus commonly has a 4, 5 or 8-inch wide clapboard pattern if it is installed horizontally, or a 4, 5, 8, etc. woodboard pattern (board and batten) if it is installed vertically. Also, if the panels are made of vinyl, they preferably have a wood textured finish on their exterior surfaces.

The siding panels 12 are typically made of a fixed length shorter than the width of a side of most houses and thus it is necessary to splice or join two panels together at their ends. When this is necessary, the upper and lower corners of one of the two abutting ends is notched, as it is known in the art. For the present siding structure, the panels 12 are notched as shown in FIG. 5. The corner of the upper edge 26 is notched through wall portions 50, 48, 40, 42 and 44 and the corner of the lower edge 28 is notched through wall portions 34 and 36. Then, when a notched panel is joined with another panel (which is left unnotched), the two front surfaces will overlap to the extent of the notching and provide a more secure and aesthetical joint.

The sheets of insulation 18 are also notched to facilitate end-to-end joining of panels and to reduce air filtration through the joint laps of the insulation. As shown in FIG. 5, one half of the thickness of the insulation is cut away to form a flange 80. The opposite end of the insulation (not shown) is cut away to form a similar flange which is the reverse of flange 80 so that the two flanges can be overlapped when the panels are abutted.

When the inventive siding panels are installed, two separate and distinct air spaces are provided between the outer wall 13 of the siding and the wall 14 of the house. A first elongated air space 90 formed of one or two compartments is provided between the outer wall of the panels and the insulation layer. A second elongated air space 92 is provided between the insulation layer and the surface of the building (house). The two air spaces are insulated from each other and there is minimal (as little as possible) air filtration into the second space 92. Thus, the space 92 can be viewed for practical purposes as a "dead air space".

In order to prevent a build-up of undesired moisture in the air space 92 means (i.e. other than the lap joints which are not sealed) may be provided for putting all of the "dead air spaces" behind all of the courses of paneling on one side of the house in communication with one another and also in communication with the moisture removal (ventilation) system of the building or house involved. For this purpose, notches 94 may be cut (for example, with a saw) at periodic distances along the nailing flanges 50 of the upper edges 26 of the panels and a series of holes or slots 96 may be provided in the wall members 48. It is also possible to have the notches 94 extend through the wall members 48 and thus dispense with the necessity of providing holes 96. These openings through the rib members 52 on the nailing flanges, as well as in the walls 48, in conjunction with the lap joints, allow all of the dead air spaces to be in fluid communication behind the layer of insulation 18. To allow the moisture which is formed in such spaces to pass from behind the siding, a further series of slots, holes or openings 98 (FIG. 4) are formed in the soffit or overhanging portion of the house or building. The openings 98 put the dead air space in communication with the normal attic exhaust air system of the house. Since the air in the dead air space will be warmer than the outside air, the moistured air will rise naturally and also be sucked out of the dead air space by the cooler air being pulled through the normal openings 100 in the soffits 70 and into and through the attic or overhead crawlspace 102.

The double air spaces significantly decrease the air filtration which normally exists with known insulated siding systems. Since the siding panels only come into contact with the house exterior surfaces every eight inches, the amount of thermal conductivity present is also significantly reduced. The conductivity also is substantially lower when the paneling is made of vinyl since vinyl is much lower—on the order of one-fourth as much in thermal conductivity than either aluminum or steel. Due to these features, the invention significantly increases the "R" factor which indicates the insulative ability of a product or system and thus provides an insulated siding system which is superior over any known system today.

While it is apparent that the preferred embodiments illustrated herein are well calculated to fulfill the objects above stated, it will be appreciated that the present invention is susceptible to modification, variation and change without departing from the scope of the invention, as defined by the following claims.

I claim:

1. A vinyl siding system for application to an outer surface of a building, said system comprising a plurality of interconnected elongated siding panels having outer wall members, two elongated edges, first channel means adjacent one of said edges and second channel means adjacent the other of said edges, elongated insulation members having two elongated edges and positioned in each of said siding panels, said insulation members extending between said first and second channel means and having their edges positioned therein, said insulation members being disposed in spaced, substantially parallel relationship to said surface of said building and to said outer wall members of said siding panels, a plurality of first air chambers formed between said outer wall member of the siding panels and said insulation members, a plurality of second air chambers formed between said insulation members and said surface of said building, means positioned in said second air chambers for securing said siding panels to said building, said means not being in contact with said insulation members, with said outer wall members of said siding panels, or with said outside ambient environment, means for interconnecting adjacent siding panels together to form a layer of siding on said surface of said building, and means for placing said plurality of second air chambers in fluid communication with one another and in fluid communication with the ventilation system of said building.

2. An insulating vinyl siding panel structure for application to a building surface and inhibiting thermal flow between said building and the ambient environment, said structure comprising a plurality of interconnected siding panels having outer surfaces spaced from said building surface, insulation means disposed within said siding panels and being spaced from, substantially parallel to and positioned between said outer surfaces and said building surface forming first and second air spaces, said insulation means having two edges, retaining means for retaining said insulation means along said two edges in said siding panels, said retaining means comprising a first channel means adjacent one elongated edge of said siding panels and a second channel means adjacent the other elongated edge of said siding panels, securing means for securing said siding panels to said building surface, said securing means positioned in a non-contacting relationship relative to each of said surfaces, said insulation means and said ambient environment, and means on said siding panels for interconnecting adjacent siding panels together.

3. A structure as set forth in claim 2 wherein said means for interconnecting adjacent siding panels together comprises tongue and groove means.

4. A structure as set forth in claim 2 further comprising means for placing the second air spaces in the plurality of siding panels in communication with one another.

5. A structure as set forth in claim 2 wherein said siding panels and insulation means are notched for end-to-end interconnection between two siding panels.

6. A structure as set forth in claim 2 further comprising means for placing the second air spaces in communication with the ventilation system of the building.

7. An insulating vinyl panel structure for application to a surface of a building for inhibiting thermal flow between said building surface and the ambient environment, said structure comprising at least one elongated panel section, said section having an outer wall member, two elongated edge means, first channel means positioned adjacent one of said elongated edge means and second channel means positioned adjacent the other of said elongated edge means, an elongated insulating member positioned in said panel section and also positioned in and extending between said first and second channel means, said insulating member disposed in a substantially parallel relation to said outer wall member and being spaced therefrom defining a first air chamber, and means for securing said panel section to said building surface, for positioning said insulating member in a substantially parallel relationship to said building surface, and for defining a second air chamber between said insulating member and said building surface.

8. An insulating panel structure as set forth in claim 7 further comprising means in said two elongated edge means for placing said second air chamber in fluid communication with other corresponding air chambers when said panel structure is installed on said building surface adjacent other similar panel structure.

9. A structure as set forth in claim 7 wherein said insulating member comprises a sheet of insulating foam and a metallic foil backing disposed on at least one side of said sheet.

10. A structure as set forth in claim 7 wherein said insulating member comprises a sheet of polystyrene foam material.

11. A structure as set forth in claim 7 wherein said panel section includes tongue and groove means along its edges for interengagement of said section with other similar panel sections.

12. An insulating vinyl panel siding system in which an insulated panel siding structure is affixed to a surface of a building and said building has ventilation means for removing air from a portion thereof, said system comprising a plurality of elongated siding panels, said panels having an outer wall means, an upper edge and a lower edge, tongue means formed on said lower edge, groove means formed on said upper edge, first channel means adjacent said upper edge and second channel means adjacent said lower edge, and a nailing flange connected to said upper edge, insulation means positioned in said panels, said insulation means extending between and positioned in said first and second channel means, and being spaced from, substantially parallel to, and disposed between said building surface and said outer wall means, a first air chamber formed between said outer wall means and said insulation means, and a second air chamber formed between said insulation means and said building surface.

13. The system as set forth in claim 12 wherein said panels are made from polyvinyl chloride and said insulation means comprises a sheet of insulating foam.

14. The system as set forth in claim 12 wherein said panels are in contact with said building surface only at said nailing flange.

15. The system as set forth in claim 12 wherein adjacent panels are interconnected together by means of said tongue means of one panel being positioned in said groove means in an adjacent panel.

16. The system as set forth in claim 12 wherein said groove means includes elongated rib means formed on said nailing flange.

17. The system as set forth in claim 12 further comprising means for placing the second air chambers in said plurality of panels in fluid communication with one another.

18. The system as set forth in claim 12 further comprising means for placing said second air chambers in said plurality of panel in fluid communication with one another and with said ventilation means.

19. The system as set forth in claim 12 further comprising support means for supporting said insulation means in said panels at a point between said first and second channel means.

* * * * *